US008382509B2

(12) United States Patent
David et al.

(10) Patent No.: US 8,382,509 B2
(45) Date of Patent: Feb. 26, 2013

(54) ELECTRICAL CONNECTOR ASSEMBLY INCLUDING COMPLIANT HEAT SINK

(75) Inventors: James J. David, Mechanicsburg, PA (US); Steven E. Minich, York, PA (US); Timothy W. Houtz, Etters, PA (US); Arkady Y. Zerebilov, Lancaster, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 13/198,194

(22) Filed: Aug. 4, 2011

(65) Prior Publication Data

US 2012/0052720 A1 Mar. 1, 2012

Related U.S. Application Data

(60) Provisional application No. 61/371,590, filed on Aug. 6, 2010.

(51) Int. Cl.
*H01R 13/00* (2006.01)

(52) U.S. Cl. ..... 439/487; 439/331; 439/342

(58) Field of Classification Search ..... 439/266, 439/326, 327, 331, 342, 485, 487
See application file for complete search history.

(56) References Cited

U.S. PATENT DOCUMENTS 6,189,376 B1 2/2001 Shock et al.
6,278,610 B1 * 8/2001 Yasufuku et al. ..... 361/704
6,980,437 B2 12/2005 Bright
7,224,582 B1 5/2007 Saturley et al.
7,405,931 B2 7/2008 Saturley et al.
7,625,223 B1 12/2009 Fogg
7,764,504 B2 * 7/2010 Phillips et al. ..... 361/715
7,974,098 B2 7/2011 Oki et al.
2003/0161108 A1 8/2003 Bright et al.
2004/0203289 A1 * 10/2004 Ice et al. ..... 439/607
2005/0195565 A1 9/2005 Bright
2008/0199187 A1 8/2008 Andersson et al.
2008/0285236 A1 11/2008 Phillips et al.
2009/0109627 A1 4/2009 Murr et al.
2010/0009558 A1 1/2010 Lin et al.
2011/0051373 A1 3/2011 McColloch
2012/0052720 A1 * 3/2012 David et al. ..... 439/487

* cited by examiner

*Primary Examiner* — James Harvey
(74) *Attorney, Agent, or Firm* — Woodcock Washburn LLP

(57) ABSTRACT

An electrical connector system includes a first electrical connector having a mounting interface and a mating interface, wherein the mounting interface is configured to electrically connect to an electrical component, and the mating interface is configured to electrically connect to a complementary electrical connector along a forward insertion direction. The electrical connector system further includes a heat sink disposed forward of the first electrical connector, the heat sink defining an engagement surface configured to contact the complementary electrical connector when the first electrical connector is mated with the complementary electrical connector. The heat sink is movably supported in a direction substantially perpendicular with respect to the insertion direction so as to maintain the engagement surface in thermal contact with the complementary electrical connector.

16 Claims, 15 Drawing Sheets

ELECTRICAL CONNECTOR ASSEMBLY INCLUDING COMPLIANT HEAT SINK

CROSS-REFERENCE TO RELATED APPLICATIONS

This application claims the benefit of U.S. Provisional Patent Application Ser. No. 61/371,590 filed on Aug. 6, 2010 the disclosure of which is hereby incorporated by reference as if set forth in its entirety herein.

BACKGROUND

Electrical connectors include a connector housing that carries a plurality of electrical contacts configured to electrically connect a pair of electrical components. For instance, the electrical contacts can electrically connect to a cable at one end, and can mate with a complementary electrical connector at a mating end, thereby placing the electrical connector in electrical communication with the cable. In some instances, it is desirable to facilitate heat dissipation from the electrical connector.

Conventional cage assemblies can include heat sinks that extend up from an EMF shielding cage that surrounds the electrical connector, and thus dissipate heat along a direction vertically up from the cage. Unfortunately, such cage assemblies can produce vertical footprint or stack height of the electrical connector assembly beyond the space in the chassis that is desired to be allocated to the electrical connector assembly.

SUMMARY

In accordance with one embodiment, an electrical connector system includes a cage, a spring clip, and a heat sink. The cage can be configured to at least partially surround an electrical connector that is mounted on a printed circuit board, the cage configured to shield EMF radiation. The spring clip includes a spring clip body that is attached to the cage. The spring clip further includes at least one spring arm that extends from spring clip body along a direction of extension. The heat sink is attached to the at least one spring arm such that the heat sink is suspended by the at least one spring arm at a position that is movable with respect to the cage along a direction that is substantially perpendicular to the direction of extension.

BRIEF DESCRIPTION OF THE DRAWINGS

The foregoing summary, as well as the following detailed description of an example embodiment of the present disclosure, will be better understood when read in conjunction with the appended drawings, in which there is shown in the drawings an example embodiment for the purposes of illustration. It should be understood, however, that the present disclosure is not limited to the precise arrangements and instrumentalities shown. In the drawings.

DETAILED DESCRIPTION

Figure 1:
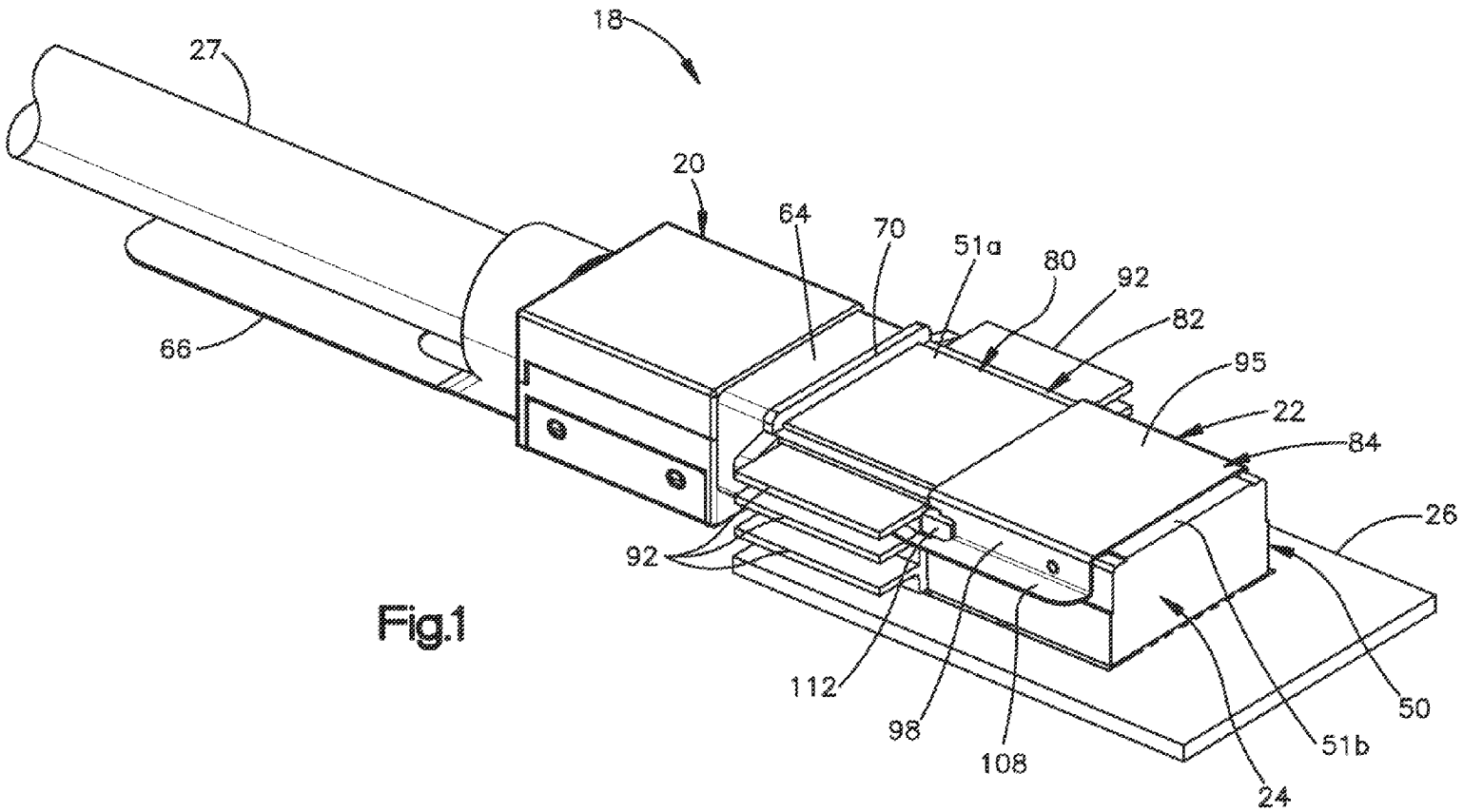
FIG. 1 is a perspective view of an electrical connector assembly that includes an electrical connector system constructed in accordance with one embodiment, having a first electrical connector that is mated with a second electrical connector.

Referring to FIG. 1-3C generally, an electrical connector assembly 18 includes an electrical connector system 22 illustrated as a cage assembly that, in turn, includes a first electrical connector 24, and a second electrical connector 20 configured to mate with the first electrical connector 24. The second electrical connector 20 can comprise a high-speed electro-optical transceiver. In accordance with one embodiment, the electrical connector assembly 18 can be referred to as an optical transceiver assembly. The second electrical connector 20 is configured to electrically connect to a complementary electrical component, such as a high-speed copper or fiber-optic cable 27, and the first electrical connector 24 is electrically connected to a substrate 26 which can be provided as a printed circuit board. The first and second electrical connectors 24 and 20 are configured to mate with each other so as to place the substrate 26 in electrical communication with the cable 27.

The first electrical connector 24 includes a connector housing 30 that defines a top end 32, an opposed bottom end 34, a front end 36, an opposed rear end 38, and opposed sides 40. The connector housing 30 may be made from any suitable dielectric or insulative material, such as a plastic, and can be injection molded or otherwise fabricated using any desired process. The front and rear ends 36 and 38 are spaced apart along a longitudinal direction L, the opposed sides 40 are spaced apart along a lateral direction A that is substantially perpendicular with respect to the longitudinal direction L, and the top and bottom ends 32 and 34 are spaced apart along a transverse direction T that is substantially perpendicular with respect to the lateral direction A and the longitudinal direction L. In accordance with the illustrated embodiment, the transverse direction T is oriented vertically, and the longitudinal and lateral directions L and A are oriented horizontally, though it should be appreciated that the orientation of the connector housing 30 may vary during use. In accordance with the illustrated embodiment, the first and second electrical connectors 20 and 24 are configured to mate along a mating direction M that extends along the longitudinal direction L. The connector housing 30 can retain a plurality of contacts that can be stitched into the housing 30, or carried by insert molded leadframe assemblies (IMLAs) as desired. The electrical contacts define mating ends configured to electrically connect to the electrical contacts of the first electrical connector, and mounting ends that are configured to engage electrical traces of the substrate 26 when the first electrical connector 24 is mounted onto the substrate 26.

The connector housing 30 defines a mating interface 42 disposed proximate to the front end 36 and a mounting interface 44 disposed proximate to the bottom end 34. The mounting interface 44 is configured to be attached to the substrate 26 so as to place the electrical contacts of the first electrical connector 24 in electrical communication with complementary electrical traces of the substrate 26. The mating interface 42 is configured to mate with a complementary mating interface of the second electrical connector 20 so as to place the electrical contacts of the electrical connectors 20 and 24 in electrical communication. Thus, when the first electrical connector 24 is mounted to the substrate 26 and mated to the second electrical connector 20, the electrical contacts of the second electrical connector 20 are in electrical communication with the substrate 26.

The connector housing 30 includes a pair of opposed flanges 47 that are spaced in the lateral direction A and are disposed proximate to the mating interface 42. The flanges 47 can extend along a plane defined by the longitudinal and transverse directions L and T, and define a receptacle pocket 45 (see FIG. 2C) that extends between the flanges 47 and into the front end 36. The receptacle pocket 45 is configured to receive a front plug portion 20*a* of the second electrical connector 20, such that the electrical contacts of the first and second electrical connectors 24 and 20 mate. Thus, the first electrical connector 24 can be referred to as a receptacle connector having a mating interface 42 that is configured to receive the mating interface of a complementary electrical connector, such as the second electrical connector 20, though it should be appreciated that the connector housing 30 can alternatively be configured as a plug whereby the mating interface 42 is configured to be received by the mating interface of the complementary electrical connector.

In accordance with the illustrated embodiment, the mating interface 42 of the connector housing 30 is oriented substantially perpendicular with respect to the mounting interface 44. Thus, the first electrical connector 24 can be referred to as a right-angle electrical connector, and is illustrated as a right-angle receptacle connector as described above. It should be appreciated, of course that the electrical connector 24 can alternatively be configured as a vertical electrical connector, whereby the mating interface 42 and the mounting interface 44 are oriented substantially parallel to each other.

The electrical connector system 22 can further include a metallic body illustrated in the form of a cage 50 that is configured be mounted to the substrate 26 and to surround or at least partially surround the first electrical connector 24 when mounted to the substrate 26. The cage 50 includes a cage body 51 that defines a first or front body portion 51*a* and an opposed second or rear body portion 51*b* is longitudinally rearwardly spaced from the front body portion 51*a*, and is thus disposed behind the front cage portion 51*a*. The rear body portion 51*b* can be integral with the front body portion 51*a*, though it should be appreciated that the rear body portion 51*b* can alternatively be discretely connected to the front body portion 51*a* as desired. The cage body 51 defines a top end 52 and an opposed bottom end 54 spaced from the top end along the transverse direction T, a front end 56 and an opposed rear end 58 that is spaced from the front end 56 along the longitudinal direction L, and opposed side walls 60 that are spaced from each other along the lateral direction A. The cage 50 can be made from any suitable material, such as a metal, that is suitable to shield EMF radiation.

The cage 50 can define an opening 62 that extends transversely upward into the bottom end 54 of the cage body 51, for instance at the rear body portion 51*b*. The opening 62 can extend through the bottom end 54 and terminate without extending through the top end 52, or can extend through the top end 52 as desired. Accordingly, when the cage 50 is mounted to the substrate 26, the opening 62 is sized to receive the first electrical connector 24 that is mounted onto the substrate 26, such that the first electrical connector 24 is surrounded by the sides 60 and the rear 58 of the cage body 51, such as the rear body portion 51*b*, during operation. The cage body 51 includes a shroud 64 that extends longitudinally forward from the front portion 51*a* and defines a mouth 66 sized to receive the front plug portion 20*a* of the second electrical connector 20. The electrical connector assembly 18 can be configured to be mounted onto a panel 68 that defines an opening 69. For instance, the shroud 64 can be sized to be inserted into the opening 69 of the panel, such that the first and second electrical connectors 24 and 20 can be supported by the panel 68 when mated. The cage body 51 can include at least one lip 70 that protrudes out, for instance transversely out, from the shroud 64. The lip 70 is sized to abut the panel 68 when the shroud 64 is inserted through the opening 69 along the mating direction M to limit insertion of the shroud 64 through the panel opening 69. Thus, the lip 70 can define a stop surface that abuts the panel 68 so as to define a permissible depth that the shroud can extend through the opening 69. The cage body 51 defines a securement member that is configured to engage a complementary securement member of the second electrical connector 20. For instance, in accordance with the illustrated embodiment, the securement member of the cage body 51 can include at least one pocket 72, such as a pair of pockets 72 that extend into or through the shroud 64 and are configured to operatively engage (e.g., receive) a complementary latch member 102 of the second electrical connector 20 so as to releasably secure the electrical connectors 20 and 24 in the mated configuration. The pockets 72 can extend into or through the bottom of the shroud 64.

Referring to FIGS. 2A-C and 5A, the electrical connector system 22 further includes a heat sink assembly 80 configured to facilitate the dissipation of heat from the second electrical connector 20, and in particular from the front plug portion 20*a*, during operation. The heat sink assembly 80 can include a heat sink 82, which can be metallic, that can be resiliently supported at a location adjacent to, for instance spaced forward from, the first electrical connector 24 and configured to move along the transverse direction T, which is substantially perpendicular to the mating direction M, with respect to the first electrical connector 24 so as to maintain contact with the second electrical connector 20, such as the plug portion 20*a* of the second electrical connector 20. The heat sink assembly 80 can further include a biasing member such as a spring clip 84 that is connected between the cage 50 and the heat sink 82, such that the heat sink 82 can be resiliently supported by the cage 50. Thus, the spring clip 84 is configured to be supported relative to the first electrical connector 24 at a first end, and to the heat sink 82 at a second end, wherein the spring clip 84 provides a force that biases the heat sink into thermal communication with the complementary connector, and thus with the electrical connector system 22, including the first electrical connector 24.

In accordance with the illustrated embodiment, the spring clip 84 is connected to both the cage and the heat sink 82. It should be appreciated that the spring clip 84 is thus supported at a predetermined location relative to the electrical connector 24. Furthermore, it should be appreciated that the spring clip 84 can be mounted onto the electrical connector 24 if desired. The heat sink 82 defines a substantially u-shaped heat sink body 86 that includes a base 88 illustrated as a substantially planar base plate that can define a sloped front end 89, which can be beveled and can define any shape as desired, such as straight or curved. For instance, the sloped front end 89 can define an upper surface that tapers transversely down (e.g., in a direction substantially perpendicular to the mating direction M), as it extends longitudinally forward. The heat sink body 86 can further include a pair of laterally opposed arms 90 that extend from opposed lateral sides of the base 88 along the transverse direction T. For instance, the opposed arms 90 can extend up from the base 88.

The heat sink 82 further includes at least a pair of retention members such as fins 92 that project laterally out from the heat sink body 86, and in particular extend out from each of the arms 90, and are spaced, for instance in the transverse direction T. The fins 92 can lie substantially in a plane defined by the lateral and longitudinal directions L and A, though it should be appreciated that the fins can be any size and shape as desired. The heat sink 82 is illustrated as including three fins 92 that extend from each arm 90, though it should be appreciated that the heat sink 82 can include any number of fins 92 as desired. The fins 92 can extend along a portion or all of the longitudinal length of the arms 90, the fins 92 that extend from each of the respective arms 90 can be spaced along the transverse direction T.

The base 88 defines an inner surface 88*a* that defines an engagement surface configured to face and abut the bottom surface of the front plug portion 20*a* of the second electrical connector 20 during operation, and an opposed outer surface 88*b*. It is recognized that, due to manufacturing tolerances for instance, the height of the plug portion 20*a* of the second electrical connector 20 when inserted into the shroud 64 can vary slightly from connector to connector. Accordingly, in accordance with one embodiment, the heat sink assembly 80 is configured such that the height of the heat sink 82 can self adjust during operation so as to maintain the inner surface 88*a* of the base 88 in thermal contact, which can include physical contact, and thus in thermal communication with the front plug portion 20*a* of the second electrical connector 20 sufficient to dissipate a desired amount of heat from the second electrical connector 20, and thus also from the first electrical connector 24, during operation of the electrical connector assembly 18. The heat sink 82 is vertically compliant or can vertically float in the transverse direction T, which is substantially perpendicular to the mating direction M.

The heat sink body 86 defines a longitudinal length sized to fit between the lip 70 and the rear body portion 51*b*. The cage 50 can define a channel 91 that extends longitudinally rearward from the mouth 66 and is sized to receive the plug portion 20*a* of the second electrical connector 20. The channel 91 can further extend through the bottom end 54 of the cage body 51 along the transverse direction T, for instance at the front body portion 51*a* at a location between the lip 70 and the rear body portion 51*b*. The cage 50 further defines a notch 93 that extends up along the transverse direction T into the bottom end of the sides 60 at a location in alignment with the channel 91. The notch 93 is configured to receive the base 88 of the heat sink 82 such that the arms 90 extend along the laterally outer surfaces of the sides 60. The notch 93 can define a thickness in the transverse direction T that is greater than the thickness of the bottom end 54 in the transverse direction T. Accordingly, when the base 88 is seated in the notch 93, the base 88 extends into the channel 91. The arms 90 can be in contact with the sides 60 or can be spaced from the sides 60 as desired. In this regard, it should be appreciated that the front portion 51*b* of the cage 50 can be referred to as a heat sink support body that can be integrally connected to the rear portion 51*a* of the cage 50, discreetly connected to the rear portion 51*a* of the cage 50, or separate from the cage 50, such that the cage 50 is defines substantially by the rear portion 51*a*.

Figure 4:
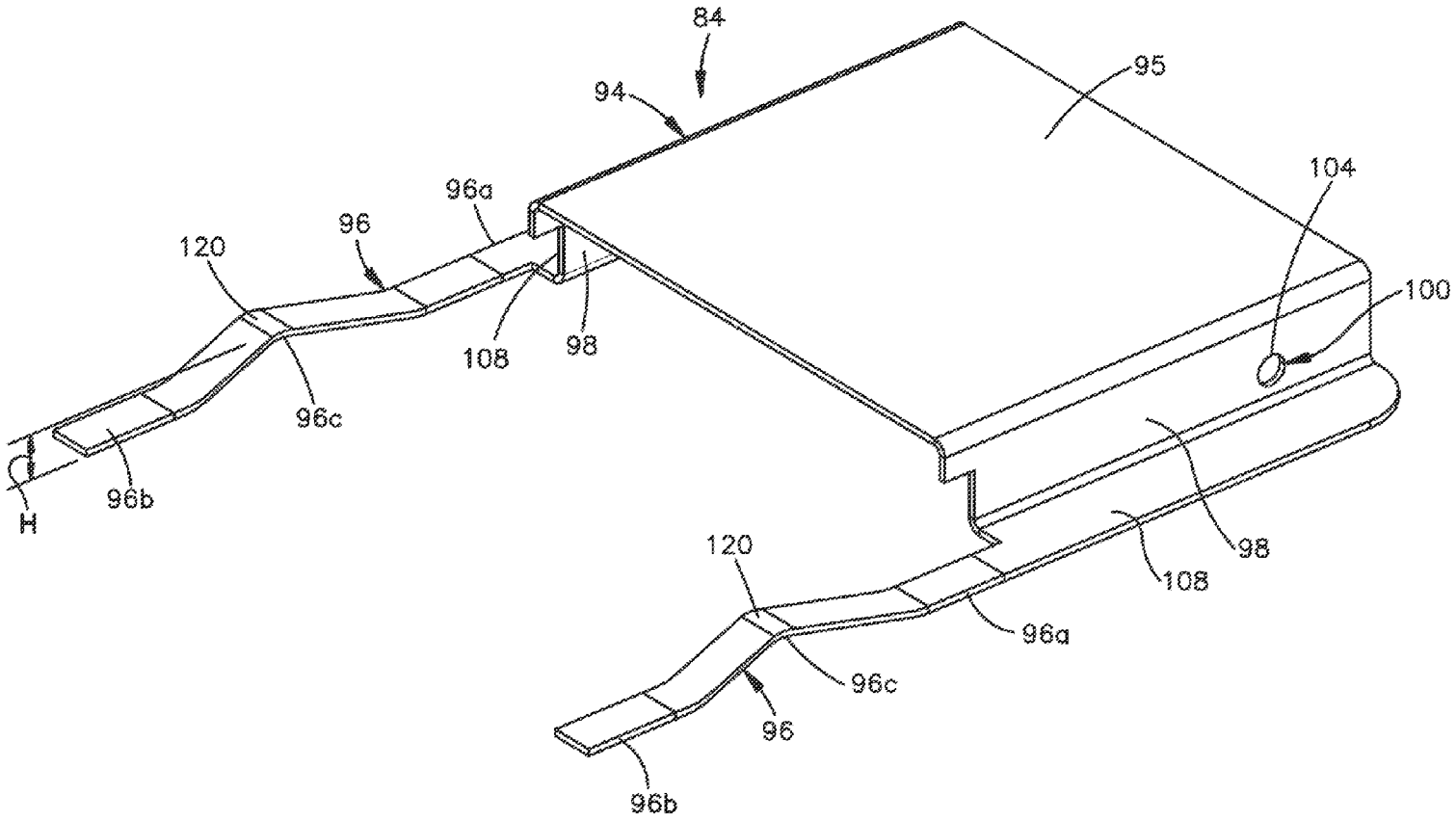
FIG. 4 is a perspective view of a spring clip constructed in accordance with one embodiment.
Figure 5A:
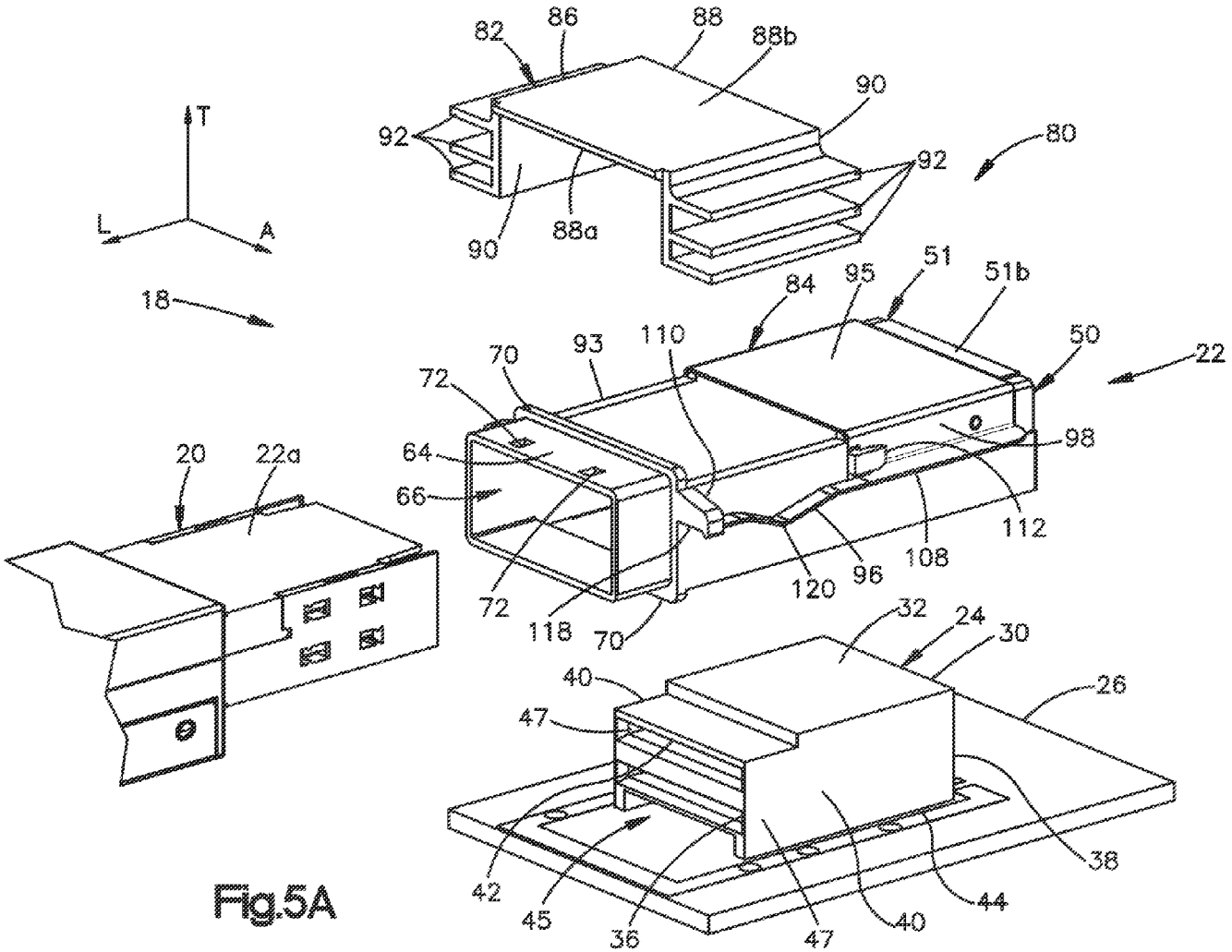
FIGS. 5A-C are perspective views of an electrical connector system constructed in accordance with an alternative embodiment.
Figure 5B:
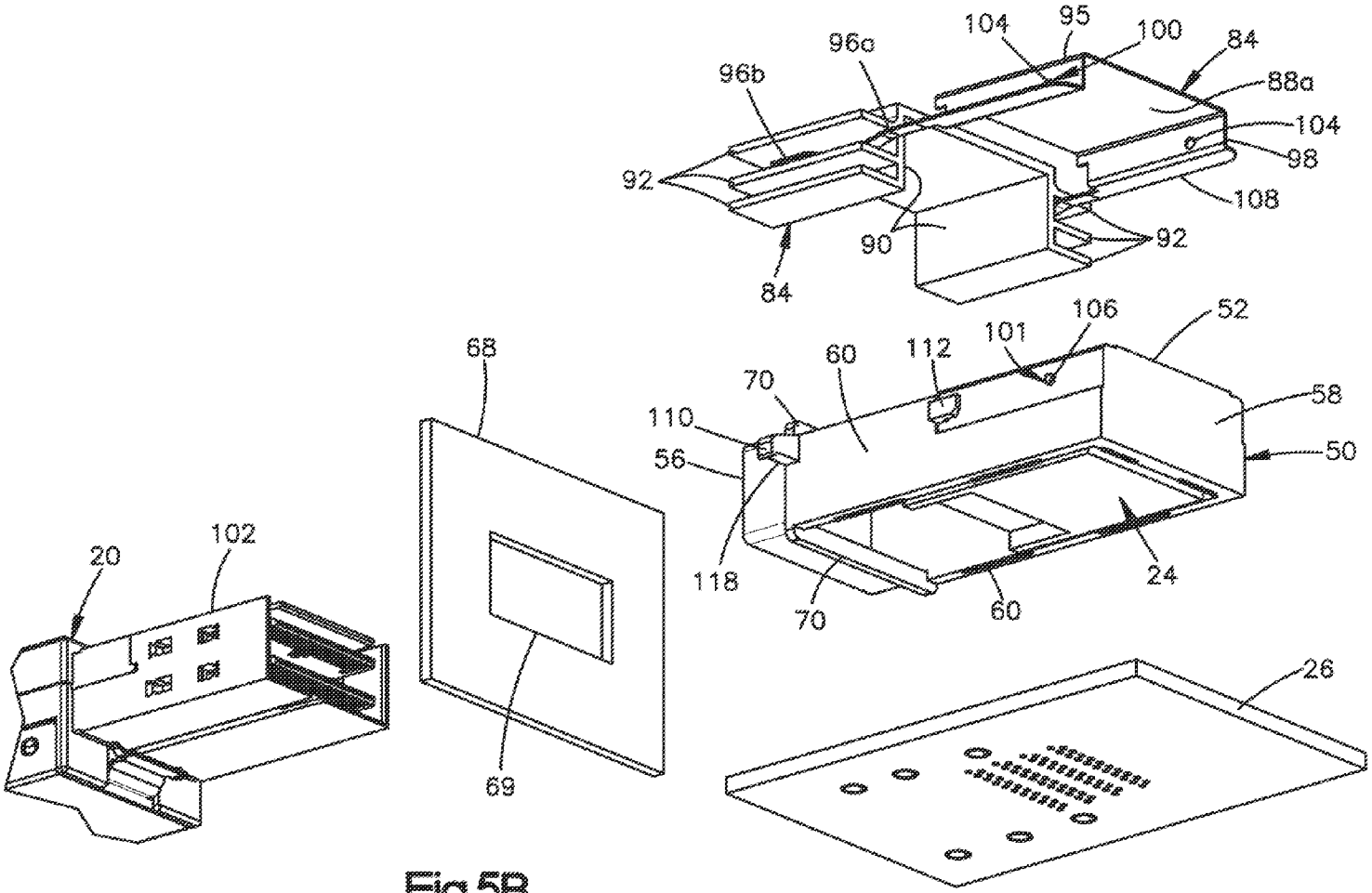
Figure 5C:
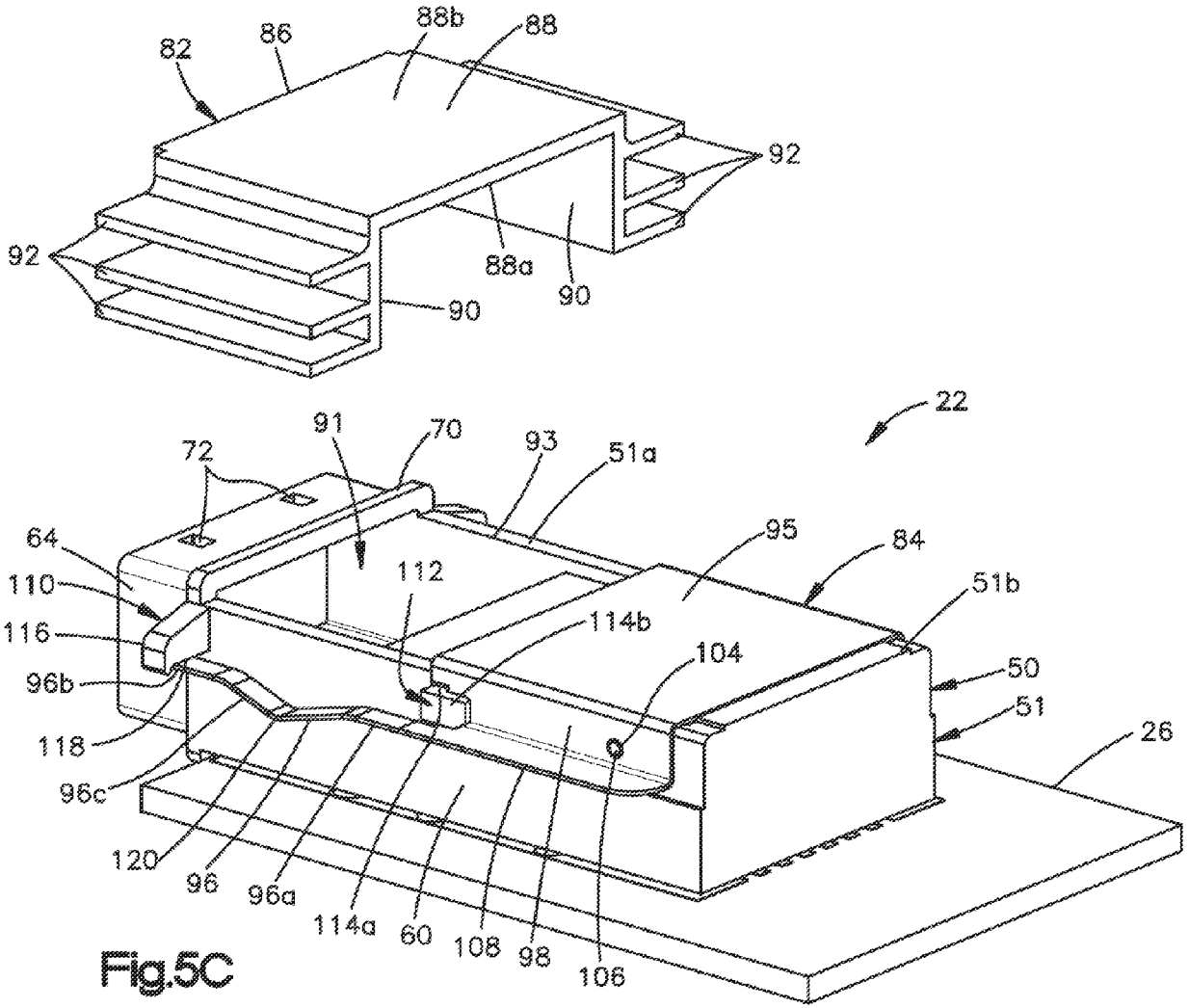
Figure 6A:
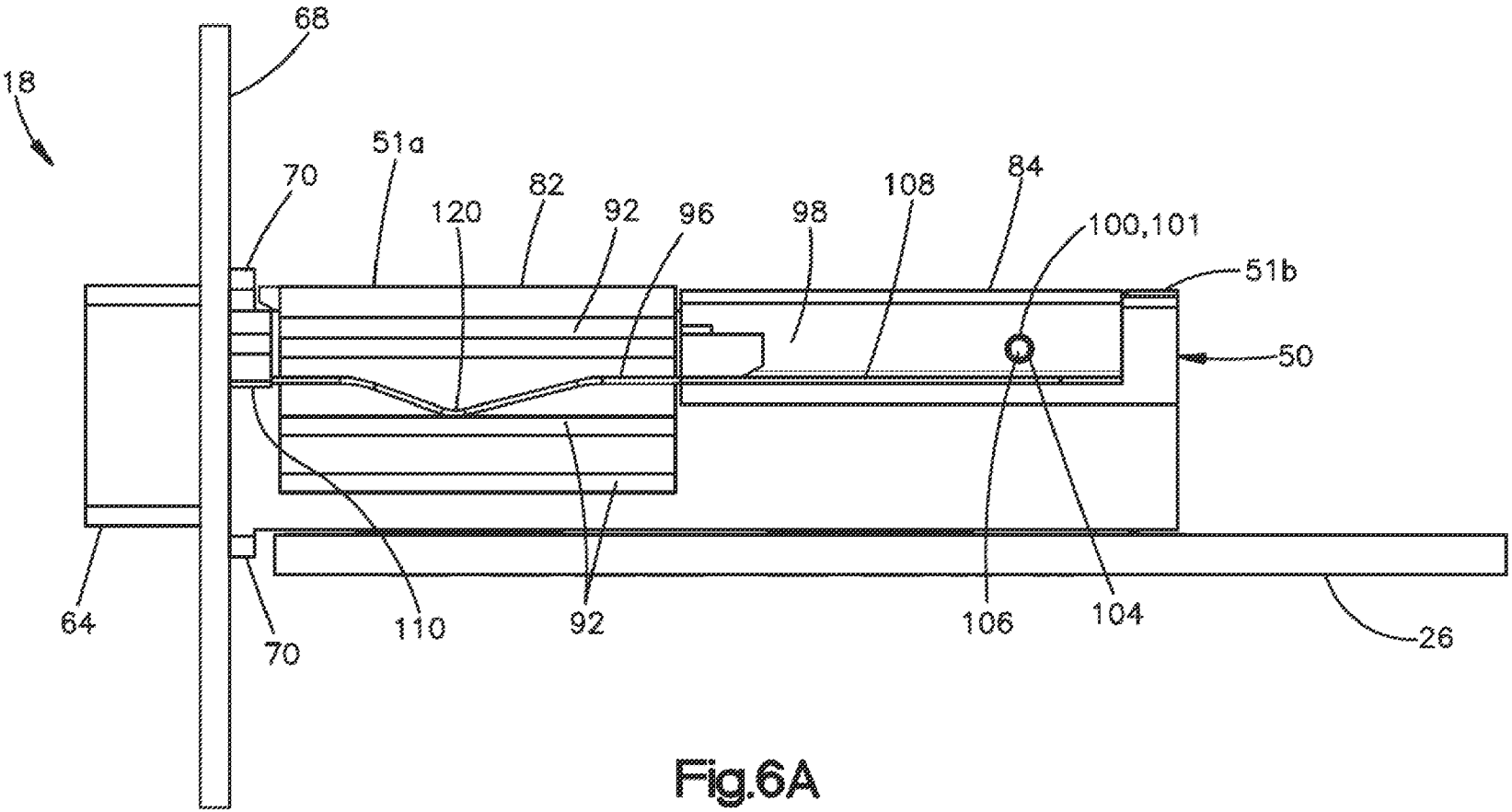
FIG. 6A is a side elevation view of the electrical connector system illustrated in FIGS. 5A-C mounted onto a panel.
Figure 6B:
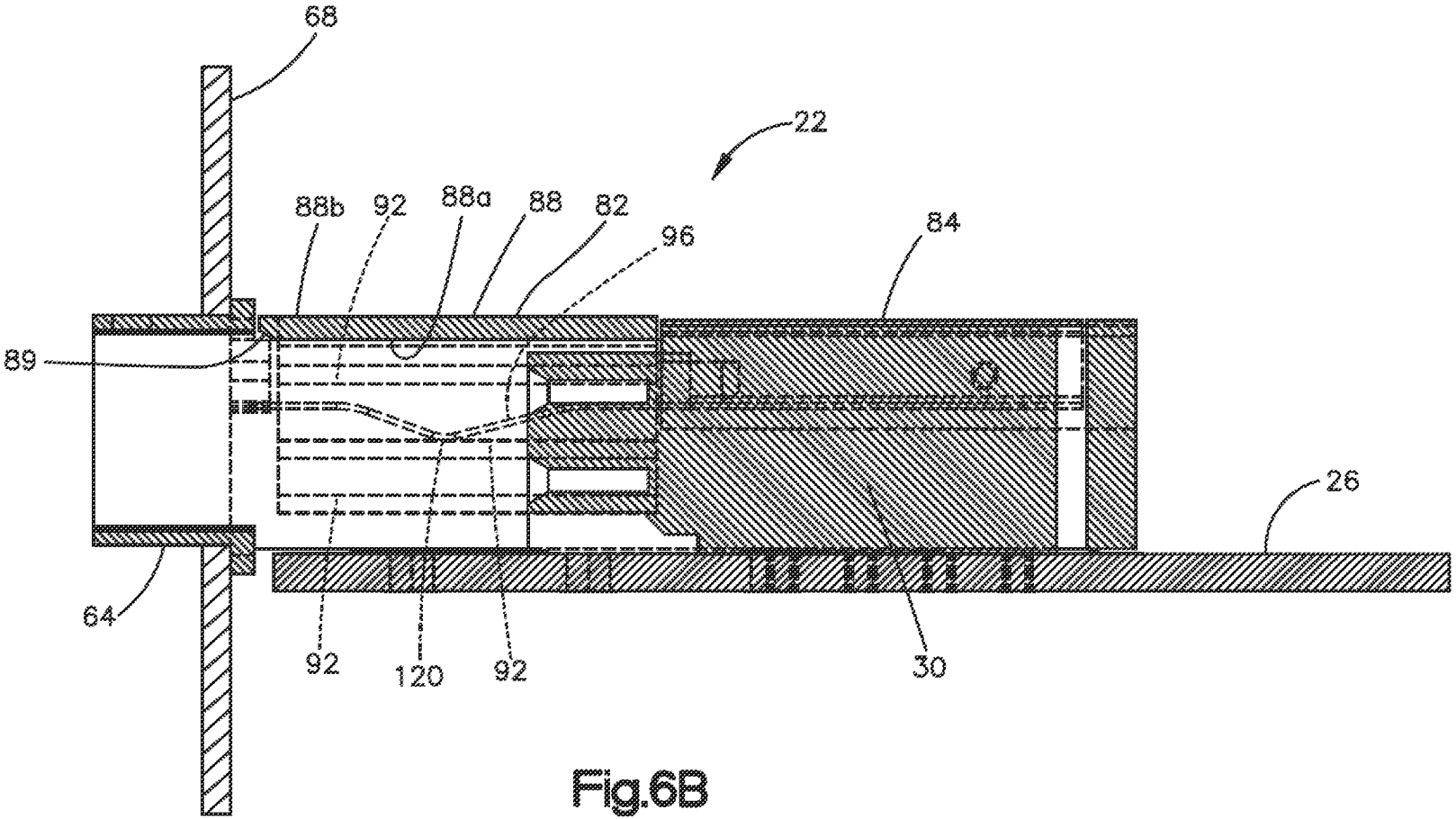
FIG. 6B is a sectional side elevation view of the electrical connector system illustrated in FIG. 6A.
Figure 6C:
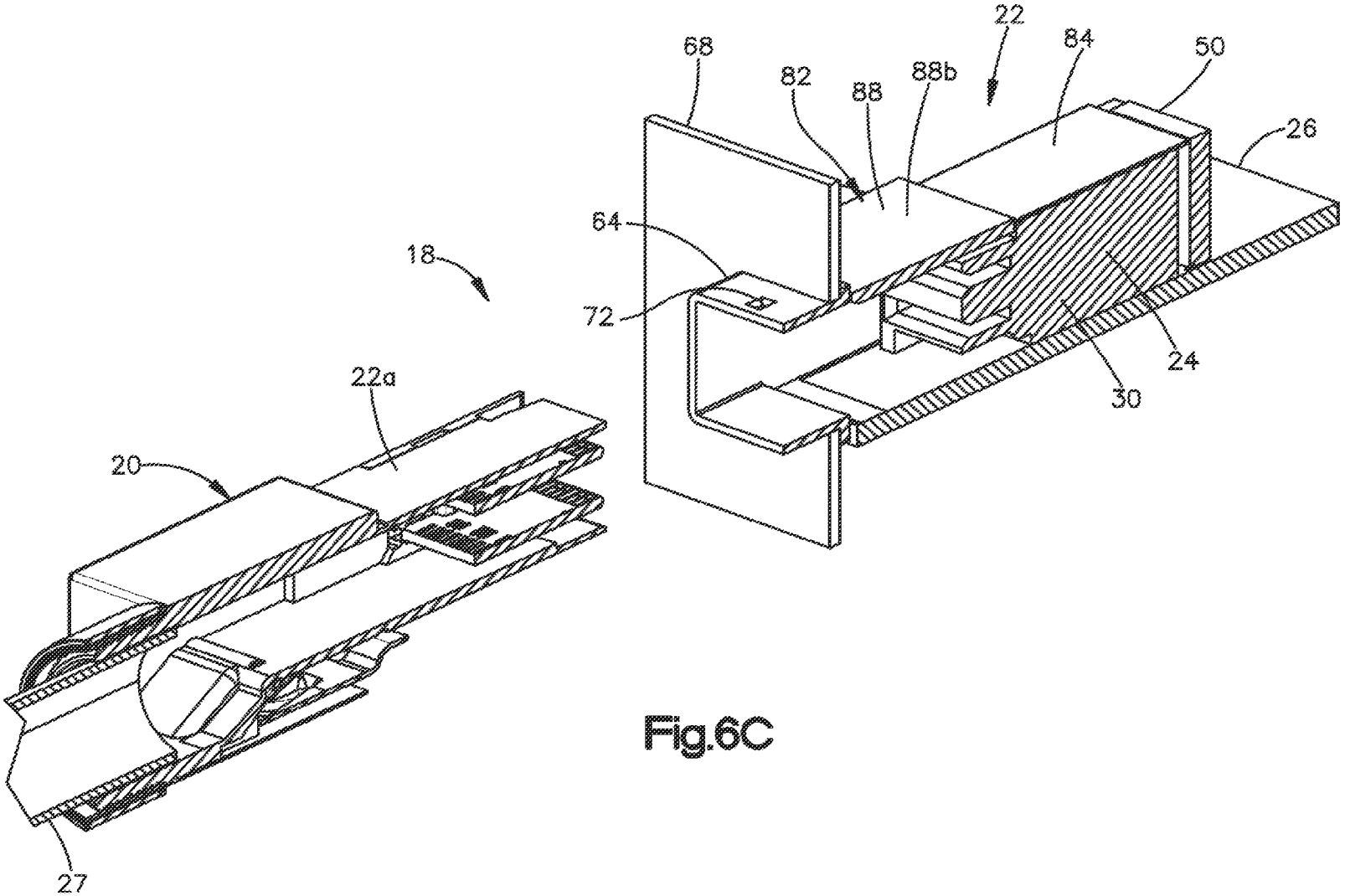
FIG. 6C is a sectional perspective view of the electrical connector assembly illustrated in FIGS. 5A-C.

The spring clip 84 provides a compliant interface that connects the heat sink 80 to the cage 50. Referring also to FIG. 4, the spring clip 84 defines a substantially U-shaped spring clip body 94 and at least one spring member such as a pair of resilient retention members which can define spring members, such as at least one spring arm 96 including a pair of spring arms 96 that are carried by the spring clip body 94, and extend from the spring clip body 94 along a direction of extension that can be substantially parallel to the mating direction M. For instance, the spring arms 96 can be integral with the spring clip body 94 or discreetly attached to the spring clip body 94. In accordance with the illustrated embodiment, the spring arms 96 extend longitudinally forward from the spring clip body 94. The spring clip body 94 includes a base 95 illustrated as a substantially planar base plate, and a pair of laterally opposed mounting walls 98 that extend transversely down from the base 95. The mounting walls 98 are laterally spaced a distance sufficient such that the spring clip body 94 can be placed over the top end 52 of the rear body portion 51*b* of the cage 51, and the cage 51 is disposed between each of the pair of the spring arms 96. The spring arms 96 can extend longitudinally forward with respect to the mounting walls 98. The cage 50 can define a rectangular recess 57 (see FIG. 2A) formed in the side walls 60 of the rear body portion 51*b* that are sized to receive the mounting walls 98.

The spring clip 84 and the rear body portion 51*b* of the cage 50 include complementary engagement members 100 and 101, respectively, that are configured to engage so as to connect the spring clip 84 to the cage 50. The engagement members 100 and 101 are illustrated respectively as apertures 104 that extend laterally into or through the mounting walls 98, and pegs 106 that project laterally out from the opposed sides 60 and. The apertures 104 are sized to receive the pegs 106 when the spring clip 52 is mounted to the cage 50, thereby mounting or otherwise operably coupling the spring arms 96 to the cage 50. It should be appreciated that the engagement members 100 and 101 can alternatively be configured as desired so as to connect the spring clip 84 to the cage 50.

The spring clip 52 further includes at least one support flange 108 such as a pair of support flanges 108 that extend laterally out from the lower end of each of the mounting walls 98, and are connected between the base 95 and the spring arms 96. Each of the spring arms 96 defines a proximal end 96*a* that extend forward from the support flanges 108, and an opposed distal end 96*b* that defines a free end spaced longitudinally forward from the proximal end 96*a*.

With continuing reference to FIGS. 1-3C, the cage 50 can include at least one first spring support member 110, such as a pair of first forward spring support members 110. For instance, each of the forward spring support member 110 can be carried by a respective one of the pair of side walls 60 of the cage body 51. The cage 50 can further include at least one second spring support member 112, such as a pair of second rear spring support members 112 each carried by the side walls 60 of the cage body 51. Each rear spring support member 112 can be carried by a respective one of the pair of side walls 06 of the cage body 51. In accordance with the illustrated embodiment, each of the rear spring support members 112 includes a support arm 114*a* that extends laterally out from the respective side wall 60, and a first bracket 114*b* that extends rearward from the support arm along a direction that can be substantially parallel to the respective side wall 60, so as to define a pocket 114*c* that is disposed between the first bracket 114*b* and the respective side wall 60. The pocket 114*c* is configured to receive the front end of the corresponding mounting wall 98 when the spring clip 84 is mounted to the cage 50. The mounting wall 98 can define a notched region 99 at its front end that is sized to receive the support arm 114 when the mounting wall 98 is disposed in the pocket 114*c*. Thus, the front end of each of the corresponding support flanges 108 of the spring clip 84 and a proximal end 96*a* of the corresponding spring arm 96 can rest against the lower surface of the respective first bracket 114*b*.

Each of the forward spring support members 110 includes at least one second bracket 116 such as a pair of brackets 116 that project laterally out from respective ones of the opposed side walls 60, for instance at the front body portion 51*a*. The brackets 116 define an upper support surface 118 that is positioned such that the distal end 96*b* of the spring arms 96 are supported by the brackets 116 when the spring clip 52 is mounted to the cage 50. In accordance with the illustrated embodiment, the distal ends 96*b* of the spring arms 96 are seated against the upper support surface 118 of the brackets 116. The brackets 116 and the brackets 114 are spaced apart along the longitudinal direction L a distance less than the length of the spring arms 96 in the longitudinal direction L. Thus, the spring arms 96 can extend over the first spring support member 110 and below the second spring support member 112. Otherwise stated, the spring arms 96 can extend across a first end of the first spring support member 110, and across a second end of the second spring support member 112 that is opposite the first end of the first spring support member, thereby capturing the spring arms 96 between the first and second spring support members 110 and 112. Furthermore, the first and second spring support members 110 and 112 can be spaced apart in the longitudinal direction L a distance greater than the longitudinal length of the arms 90 of the heat sink 82, such that the arms 90 of the heat sink 82 can be disposed between the first and second spring support members 110 and 112 when the heat sink 82 is mounted to the cage 50.

Referring again also to FIG. 4, each of the spring arms 96 defines a proximal end 96*b* adjacent to the respective support flange 108 and a distal terminal end 96*b*. The proximal and distal ends 96*a-b* can be substantially inline with each other or otherwise spaced from each other as desired. Each of the spring arms 96 can further define an intermediate region 96*c* that extends between the proximal end distal ends 96*a* and 96*b*, such that at least a portion of the intermediate region 96*c* is offset with respect to one or both of the proximal and distal ends 96*a* and 96*b* along the transverse direction T. For instance, each of the intermediate regions 96*c* can define an elbow 120 that is disposed transversely above the proximal and distal ends 96*a* and 96*b* so as to define a height H slightly greater than the height between adjacent fins 92 of the heat sink 82 along the transverse direction. Accordingly, the spring clip 84 can be mounted to the cage 50, such that the spring arms 96 extend between, and can be captured between, adjacent ones of a pair of the fins 92 so as to support the heat sink 82. Otherwise stated, the heat sink 82 is configured to be suspended, for instance cantilevered, by the spring arms 96 at a position that is movable relative to the cage 50, for instance along a direction substantially perpendicular to the direction of extension, and thus also substantially perpendicular to the mating direction M. The fins 92 can cause the spring arms 96 to compress, for instance at the respective elbows 120 when the spring arms 96 are disposed between the respective pair of fins 92, such that the spring arms 96 apply a retention force to the spring arms 96 that secures the spring clip 84 to the cage 50. Alternatively, the spring arms 96 can extend between the respective pair of fins 92, but not captured between the adjacent fins 92, such that the spring arms 96 can touch either one or both of the adjacent fins that define the gaps that the respective spring arms 96 are disposed in.

It should be appreciated that each of the spring arms 96 is flexible in the transverse direction T, which is substantially perpendicular to the mating direction M. Furthermore, the spring arms 96 define a spring force that biases the respective intermediate regions 96*c*, and thus the heat sink 82 when the heat sink 82 is mounted to the spring arms 96, toward a first or neutral position, for instance when the base 88 is partially disposed in the channel 91. When the intermediate regions 96*c* and heat sink 82 deflect away from the neutral position to a second or deflected position along the transverse direction T out of the recess 93 and the channel 91, the spring force biases the heat sink 82 along a direction from the second or deflected position toward the first or neutral position. Accordingly, the spring arms 96 allow the heat sink 82 to resiliently translate transversely or vertically along a direction substantially perpendicular to the mating direction M against the force of the spring arms 96 during operation. In accordance with the illustrated embodiment, the second or displaced position is away from the top end 32 of the connector housing 30, and toward the substrate 26 or mounting interface 44.

Thus, the spring arms 96 are configured to attach to the heat sink 82 such that the heat sink 82 can be displaced from a first or position to a second position, and the spring arms 96 provide a spring force that biases the heat sink 82 along a direction from the second position toward the first position, which is toward the recess 93 and the channel 91. The spring clip 84 can be mounted to the cage 50 such that the spring arms 96 are captured between the first and second spring support members 110 and 112. The heat sink 82 includes a plurality of adjacent fins 92 that extend out from each of the opposed sides of the heat sink body 86, such the fins 92 that define gaps disposed between respective adjacent ones of the plurality of adjacent fins, and the spring arms 96 extend through select ones of the gaps that extend out from each of the opposed sides of the heat sink body 86. The heat sink 82 can then be mounted to the spring clip 84, for instance, by aligning a gap between select ones of an adjacent pair of fins 92 with the support flanges 108 that are configured to guide the heat sink 82 onto the spring clip 84 such that the heat sink 82 is resiliently supported so as to move or deflect in the transverse direction T relative to the cage 50, and thus also relative to the first electrical connector 24 when the cage 50 is fixed relative to the electrical connector 24. In this regard, the support flanges 108 can be referred to as guides that guide the fins 92 onto the spring arms 96 such that the spring arms 96 are disposed between the respective pairs of fins 92. The heat sink 82 can be translated forward until the fins 92 are disposed between the first ands second spring support members 110 and 112, and the base 88 is disposed in the recess 93 and rests against the cage housing 51, for instance at the front body portion 51*a*, such that a portion of the base 88, including at least a portion of the sloped front end 89, is disposed in the channel 91. Alternatively, the heat sink 82 can be attached to the spring clip 84 in any other manner as desired such that the spring arms 96 extend between respective adjacent ones of a corresponding pair of fins 92 that extend from opposed sides of the heat sink body 86.

Figure 2A:
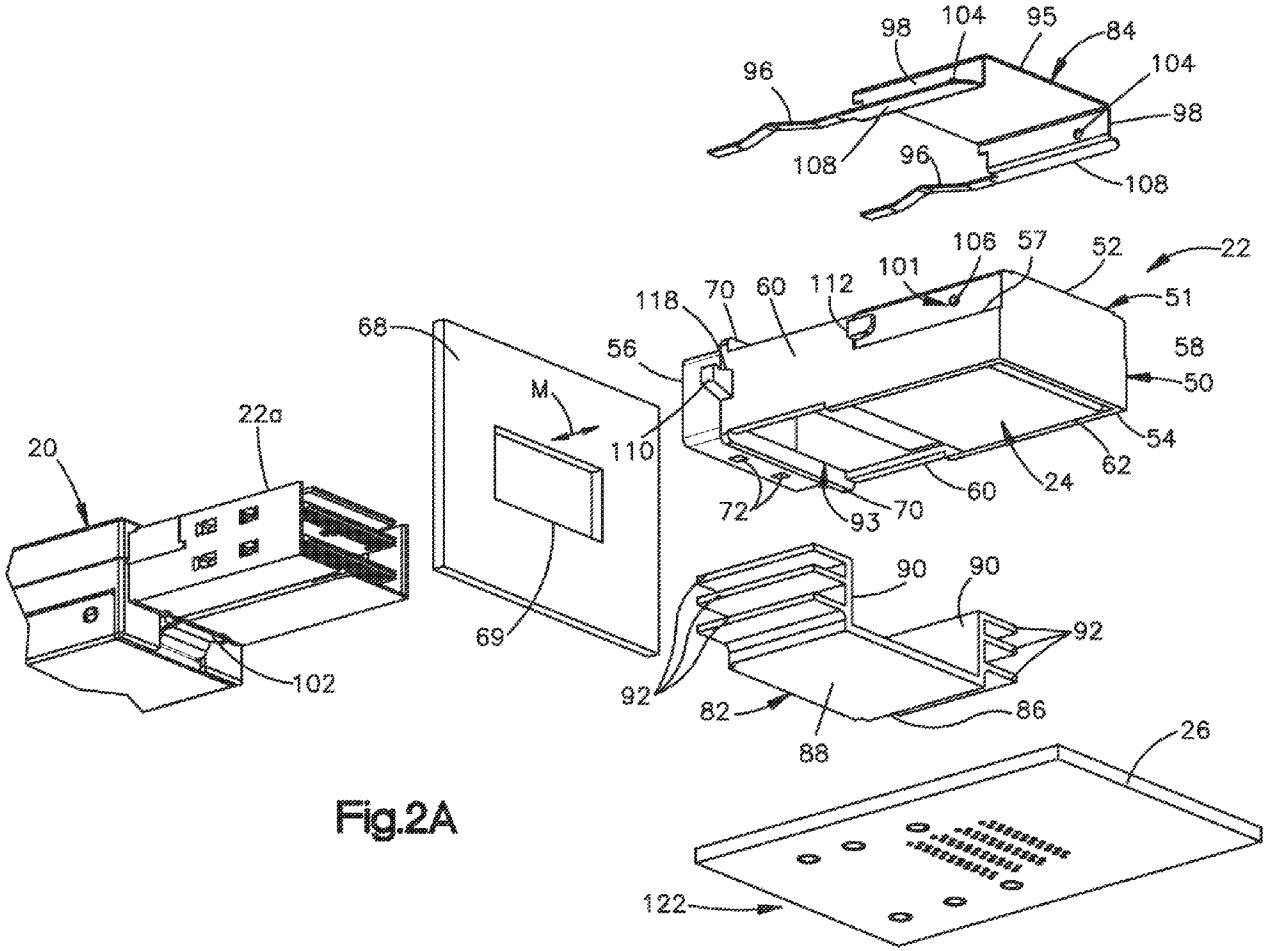
FIGS. 2A-2D are exploded perspective views of the electrical connector assembly.
Figure 2B:
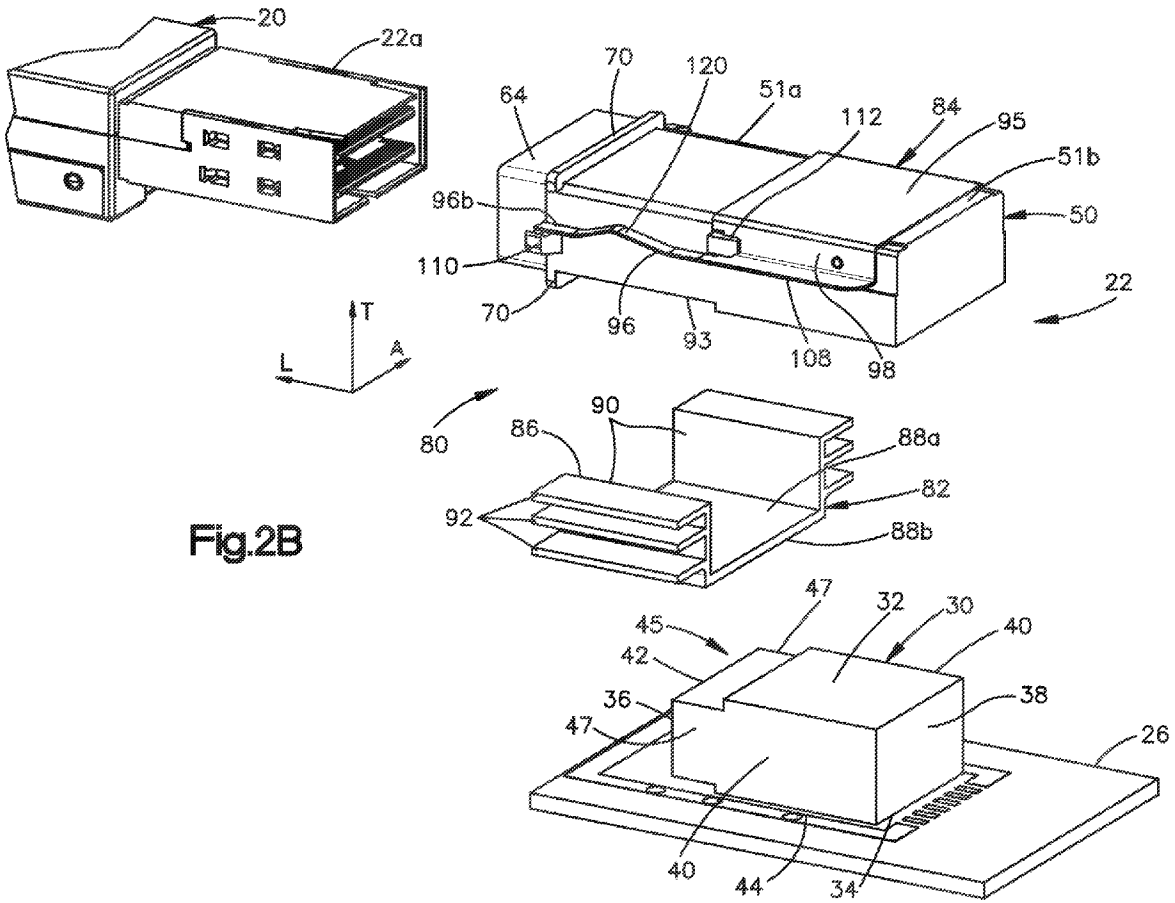
Figure 2C:
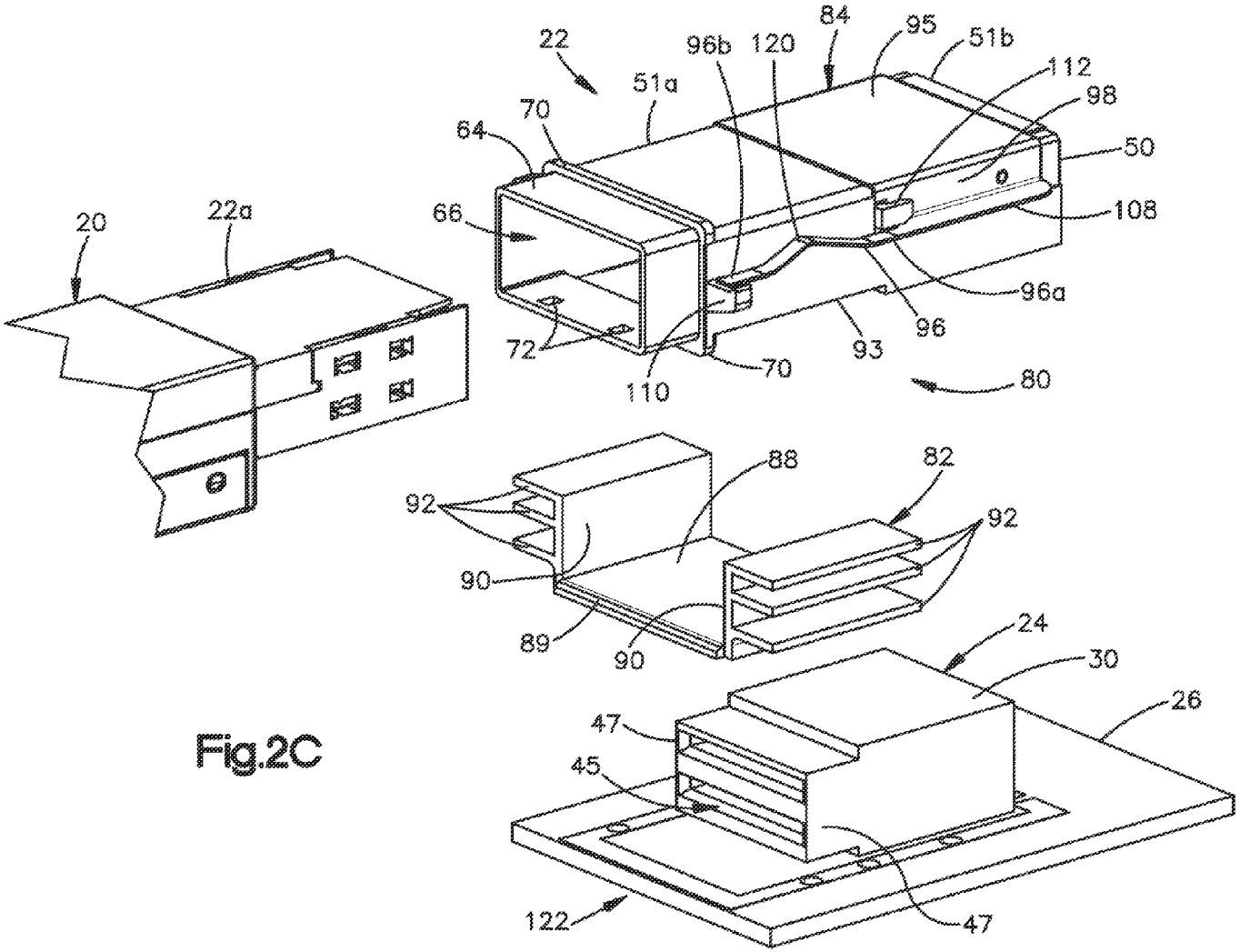
Figure 2D:
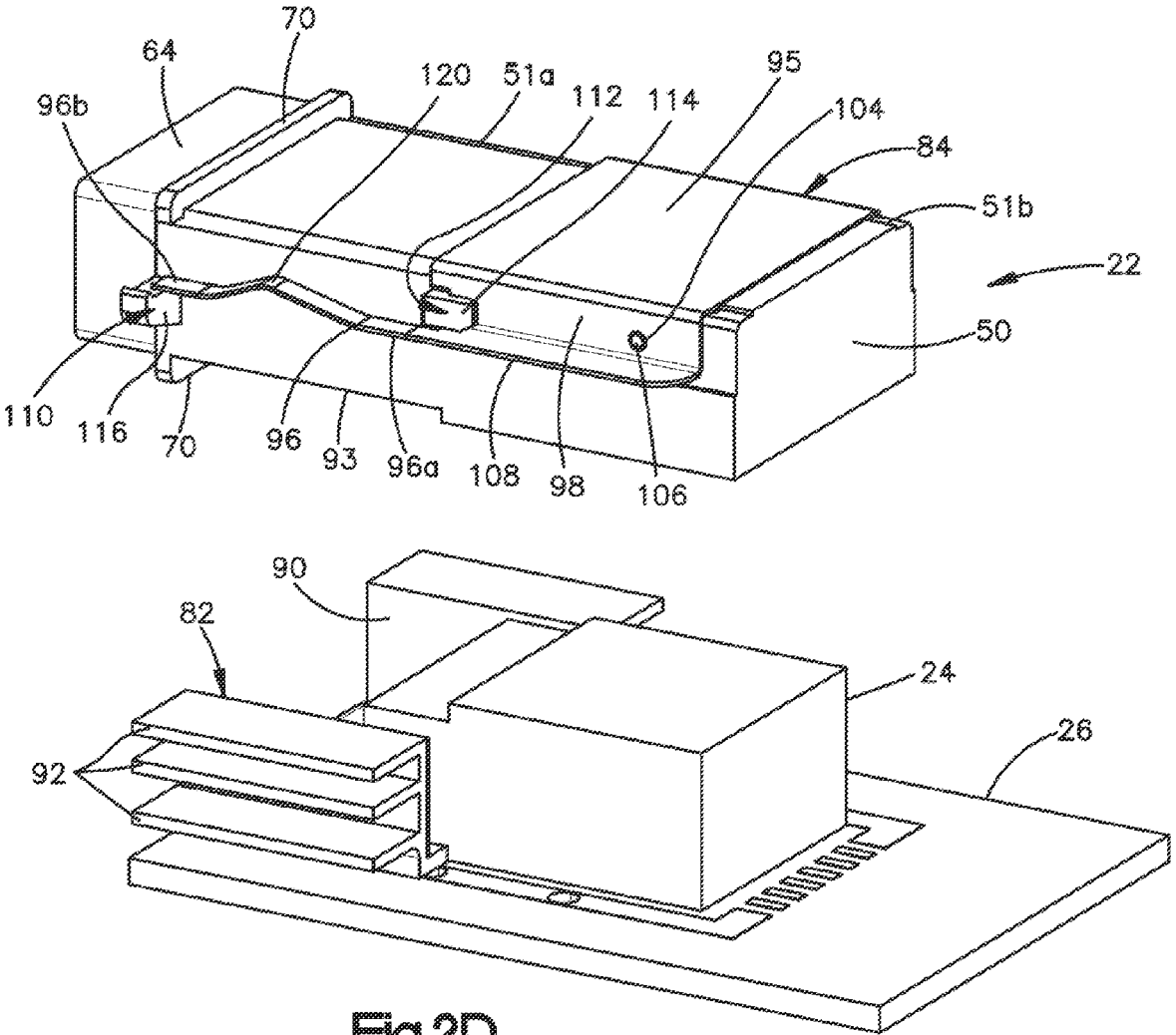
Figure 3A:
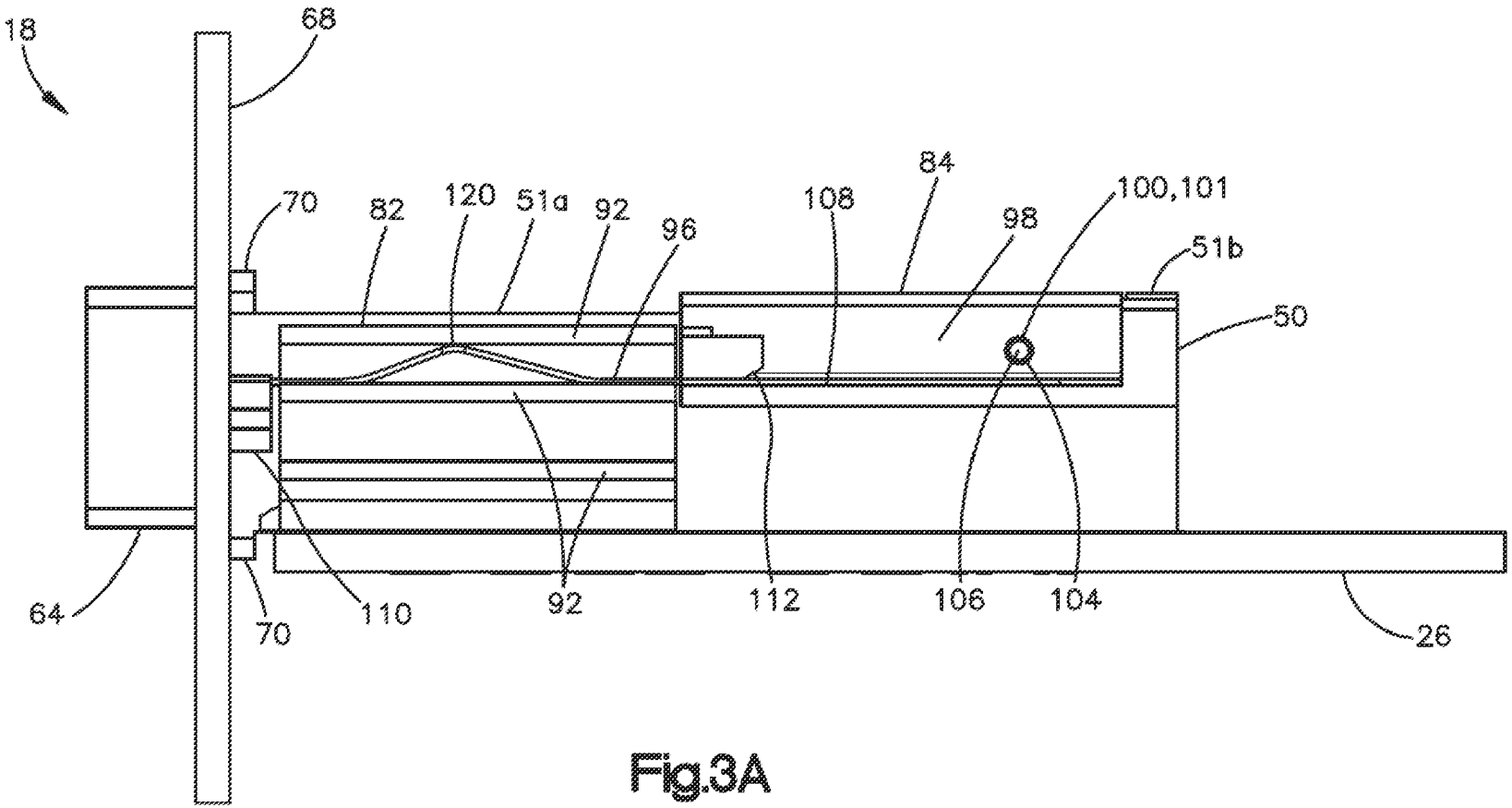
FIG. 3A is a side elevation view of the electrical connector system illustrated in FIG. 1 mounted onto a panel.
Figure 3B:
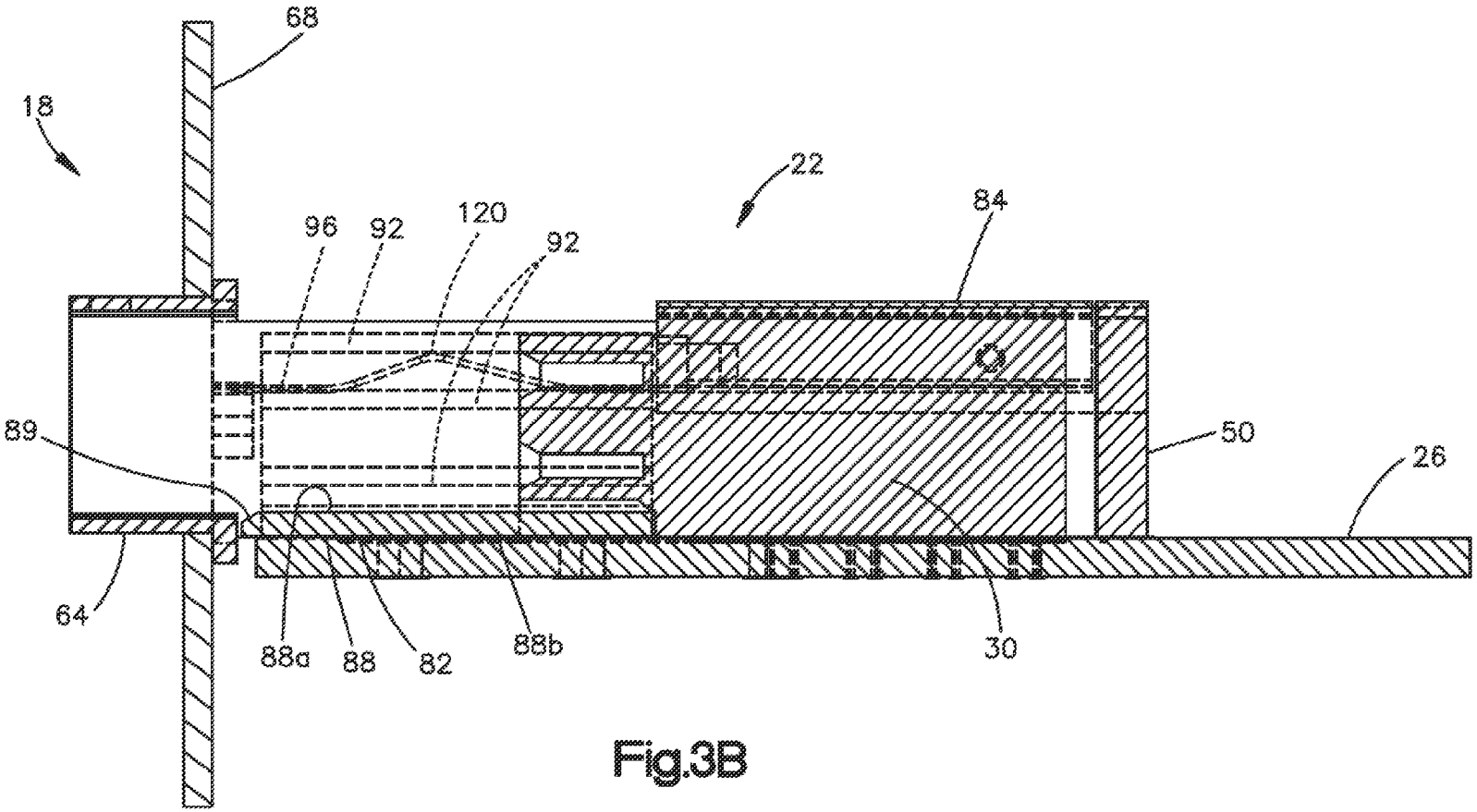
FIG. 3B is a sectional side elevation view of the electrical connector system illustrated in FIG. 3A.
Figure 3C:
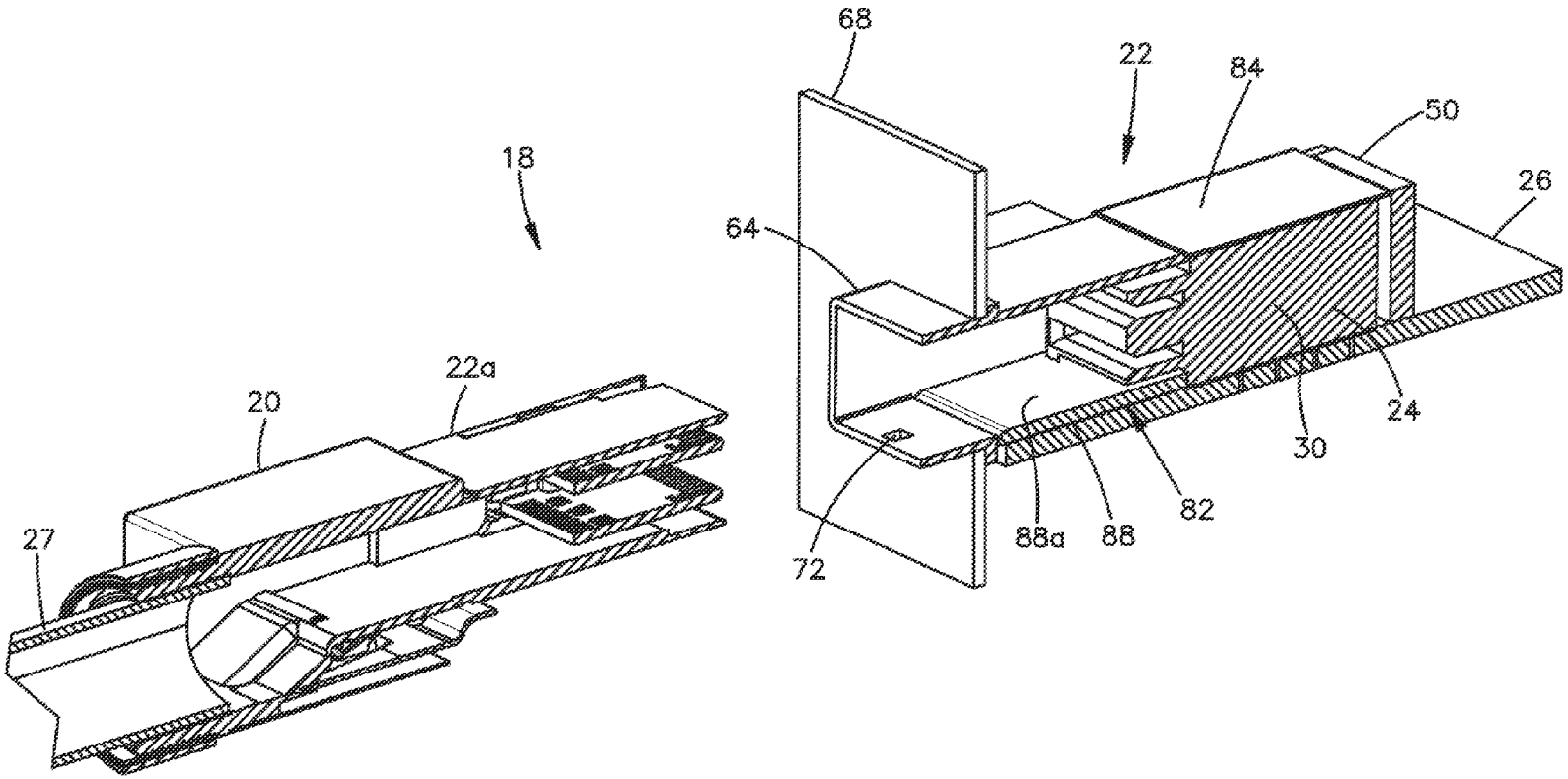
FIG. 3C is a sectional perspective view of the electrical connector assembly illustrated in FIG. 1.

When the heat sink 82 and the spring arms 96 are in the first or neutral position, the sloped front end 89 of the heat sink base 88 can be longitudinally aligned with the lower edge of the mating interface or front plug portion 20*a* of the second electrical connector 20 in the channel 91 when the front plug portion 20*a* as the plug end is inserted into the receptacle pocket 45 and into the channel 91 along the mating direction M (see FIG. 2C). For instance, as described above, the base 88 can be at least partially disposed in the channel 91 when the heat sink 82 is in the first or neutral position. Thus, as the first and second electrical connectors 24 and 20 are mated, the sloped front end 89 contacts the lower wall of the front plug portion 20*a* of the second electrical connector 20 when the heat sink 82 is in the first or neutral position. Accordingly, as the connectors 20 and 24 are mated, the beveled front end 89 rides along front plug portion 20*a*, which causes the heat sink 82 to translate down along the transverse direction T to the second or deflected position against the spring force of the spring arms 96. Thus, the spring arms 96 bias the heat sink 82 upward from the second or deflected position toward the first or neutral position such that the inner surface 88*a* of the base 88 is maintained in contact with the second electrical connector 20, for instance at the front plug portion 20*a*, such that the heat sink 82 can dissipate heat from the electrical connector system 22. Thus, the base 88 can define an engagement surface that is configured to be placed in thermal contact with the second electrical connector 20 so as to dissipate heat from the second electrical connector 20, and thus from the electrical connector system 22 as described above. It should be appreciated that the spring clip 84 is coupled to the cage 50, and is also indirectly coupled to the electrical connector 24, such that the spring arms 96 movably supports the heat sink 82 relative to the cage 50 and also movably supports the heat sink 82 relative to the electrical connector 24 when the cage 50 is fixed relative to the electrical connector 24, for instance when the cage 50 and the electrical connector 24 are mounted to the substrate 26.

As illustrated in FIG. 2A, the substrate 26 can define a pocket 122 that extends through the substrate 26 along the transverse direction T at a front end of the substrate 26. The pocket 122 can be open to the front end as illustrated, or can be enclosed as desired. The pocket 122 can be sized greater than the base 88 of the heat sink 82 such that the heat sink 82 can translate into the pocket 122 as the heat sink 82 deflects during operation. The pocket 122 can define a lateral dimension that is less than the lateral dimension between the outer tips of laterally opposed fins 92 such that the fins 92 can contact the substrate 26 so as to prevent the heat sink 82 from translating through the pocket 122.

It should be appreciated that the heat sink 82 is spaced forward with respect to the rear body portion 51*b* of the cage 51 that at least partially surrounds the first electrical connector 24, such that the receptacle pocket 45 is open to the front plug end of the second electrical connector 20. Furthermore, the uppermost fin 92 is downwardly offset with respect to the top end 52 of the rear body portion 51*b* of the cage 50 along the transverse direction T. Accordingly, the heat sink 82 does not increase the vertical stack height of the electrical connector system 22, or alternatively increases the vertical stack height of the electrical connector system 22 less than conventional cage assemblies whose heat sinks project up from the cage. Thus, the electrical connector system 22 provides a low-profile cage assembly, whereby heat dissipates from the fins 92 out the laterally opposed sides as opposed to the top.

While the electrical connector system 22 has been described such that the heat sink base 88 is disposed below the bottom end 54 of the cage 50, it should be appreciated that the electrical connector system 22 can alternatively be configured such that the heat sink 82 is top-mounted to the cage 50, such that the heat sink base 88 is disposed above the top end 52 of the cage 50.

For instance, referring now to FIGS. 5A-6C, the electrical connector system 22 is described substantially as described above, however the channel 91 extends through the top end 52 of the cage body 51 along the transverse direction T, for instance at the front body portion 51*a* at a location between the lip 70 and the rear body portion 51*b*. The cage 50 further defines a notch 93 that extends down along the transverse direction T into the top end of the sides 60 at a location in alignment with the channel 91. The notch 93 can have a thickness in the transverse direction T that is greater than the thickness of the top end 52 of the cage body 51 in the transverse direction T. The notch 93 is configured to receive the base 88 of the heat sink 82 such that the arms 90 extend along the laterally outer surfaces of the sides 60, and the base 88 is disposed in the notch 93 such that a portion of the base 88 extends into the channel 91. The arms 90 can be in contact with the sides 60 or can be spaced from the sides 60 as desired.

The heat sink 82 can thus be oriented such that the arms 90 extend down from the heat sink base 88. The elbow 120 of each spring arms 96 can be downwardly offset with respect to one or both of the corresponding proximal and distal ends 96*a* and 96*b*. The spring arms 96 can be inserted adjacent ones of a respective pair of adjacent fins 92 in the manner described above, such that the fins 92 retain the spring arms 96 so as to secure the heat sink 82 to the cage body 51, and thus the cage 50. Accordingly, during operation, the heat sink 82 can translate from a first or neutral position to a second or displaced position, such that the spring arms 96 bias the heat sink 82 along a direction from the second or displaced position toward the first or neutral position. Thus, as the plug portion 20*a* of the second electrical connector 20 is inserted into the mouth 66 and the channel 91 of the cage 50, the plug portion 20*a* rides along the sloped front end 89 of the heat sink 82, which causes the heat sink 82 to translated substantially along the transverse direction T (substantially perpendicular to the mating direction M) from the first or neutral position to the second or deflected position. The second displaced position is further from the substrate 26, and thus the mounting interface 44, than the first or neutral position. It should thus be appreciated that because the base 88 of the heat sink 82 is disposed above the cage 50 and moves away from the substrate 26, the substrate 26 can be constructed so as to be devoid of the pocket 122 described above (though of course the substrate 26 could include the pocket 122 if desired).

Furthermore, the support surface 118 of the second brackets 116 are disposed at the bottom end of the brackets 116. Accordingly, the spring arms 96 extend below the respective first bracket 114*b* as described above, and further extend below the second brackets 116. Thus, the spring arms 96 can extend across a first end of the first spring support member 110, and across a second end of the second spring support member 112 that is the same end as the first end. The ends can be bottom ends, for instance as illustrated, or can be top ends as desired. The spring arms 96 define a spring force that biases the distal ends 96*c* against the respective spring support members 110.

When the heat sink 82 and the spring arms 96 are in the first or neutral position, the sloped front end 89 of the heat sink base 88 can be longitudinally aligned with the lower edge of the mating interface or front plug portion 20*a* of the second electrical connector 20 when the front plug portion 20*a* is aligned so as to be inserted into the receptacle pocket 45 when the first and second electrical connectors 24 and 20 are moved toward each other along the mating direction M. In particular, as the first and second electrical connectors 24 and 20 are mated, the sloped front end 89 contacts the lower wall of the front plug portion 20*a* of the second electrical connector 20 when the heat sink 82 is in the first or neutral position. Accordingly, as the connectors 20 and 24 are mated, the beveled front end 89 rides along front plug portion 20*a*, which causes the heat sink 82 to translate up along the transverse direction T to the second or deflected position against the spring force of the spring arms 96. Thus, the spring arms 96 bias the heat sink 82 upward from the second or deflected position toward the first or neutral position such that the inner surface 88*a* of the base 88 is maintained in contact with the front plug portion 20*a*. It should thus be appreciated that the spring clip 84 is coupled to the cage 50, and is also indirectly coupled to the electrical connector 24, such that the spring arms 96 movably supports the heat sink 82 relative to the cage 50 and also movably supports the heat sink 82 relative to the electrical connector 24 when the cage 50 is fixed relative to the electrical connector 24.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

What is claimed:

1. An electrical connector system comprising:

a cage configured to at least partially surround an electrical connector that is mounted on a printed circuit board, the cage configured to shield EMF radiation, a spring clip including a spring clip body that is attached to the cage, the spring clip further including at least one spring arm that extends from spring clip body along a direction of extension; and a heat sink attached to the at least one spring arm such that the heat sink is suspended by the at least one spring arm at a position that is movable with respect to the cage along a direction that is substantially perpendicular to the direction of extension.

2. The electrical connector system as recited in claim 1, wherein the heat sink comprises a heat sink body and at least a pair of fins that extend out from the heat sink body, such that the at least one spring arm extends between adjacent ones of the pair of fins.

3. The electrical connector system as recited in claim 1, wherein the heat sink comprises a heat sink body and at least two pairs of fins that extend out from opposed sides of the heat sink body, and the spring clip comprises a pair of spring arms that extend forward from the spring clip body so as to extend between ones of each of the two pairs of fins, respectively.

4. The electrical connector system as recited in claim 1, wherein the cage is disposed between each of the pair of spring arms.

5. The electrical connector system as recited in claim 3, wherein the heat sink includes a plurality of fins that extend out from each of opposed sides of the heat sink body, such the fins that define gaps disposed between respective adjacent ones of the plurality of fins, and the spring arms extend through select ones of the gaps that extend out from each of the opposed sides of the heat sink body.

6. The electrical connector system as recited in claim 1, wherein the cage defines a channel sized to receive a plug end of a second electrical connector, the cage further defining a recess sized to receive an engagement surface of the heat sink, such that the engagement surface is at least partially disposed in the channel before the second electrical connector extends into the channel.

7. The electrical connector system as recited in claim 6, wherein the heat sink is configured to deflect out of the channel against a force of the biasing member when the second electrical connector contacts the engagement surface of the heat sink.

8. The electrical connector system as recited in claim 6, wherein the biasing member is configured to bias the engagement surface along a direction into the channel when the heat sink is deflected.

9. The electrical connector system as recited in claim 6, wherein the recess is disposed at an upper end of the cage.

10. The electrical connector system as recited in claim 6, wherein the recess is disposed at a lower end of the cage.

11. The electrical connector system as recited in claim 1, further comprising the electrical connector that includes a connector housing that defines a mounting interface and a mating interface, wherein the mounting interface is configured to mount to a substrate, and the mating interface is configured to electrically connect to a complementary electrical connector along a mating direction, wherein the ate least one spring arm biases the heat sink along a direction that is substantially perpendicular with respect to the mating direction.

12. The electrical connector system as recited in claim 11, wherein the at least one spring arm biases an engagement surface of the heat sink into thermal communication with the complementary electrical connector so as to dissipate heat from the complementary electrical connector.

13. A spring clip configured to be attached to a cage, and further configured to movably support a heat sink at an opposed end, the spring clip comprising a base, and at least one spring arm extending forward from the base, the at least one spring arm having a free end that is configured to support to the heat sink such that the heat sink can be displaced from a first position to a second position, and the spring arm provides a force that biases the heat sink toward the first position.

14. The spring clip as recited in claim 13, further comprising a guide connected between the at least one arm and the base.

15. The spring clip as recited in claim 14, wherein the spring arm defines a proximal end attached to the guide, the distal free end spaced from the proximal end along a longitudinal direction, and an elbow disposed between proximal end distal ends, wherein the elbow is offset with respect to at least one of the proximal and distal ends along a transverse direction that is substantially perpendicular to the longitudinal direction.

16. The spring clip as recited in claim 15, further comprising a pair of opposed spring arms that extend from corresponding opposed guides.

* * * * *